United States Patent [19]

Christiansen

[11] 4,002,420

[45] Jan. 11, 1977

[54] METHOD OF BURNING CALCINED AND UNCALCINED PULVEROUS RAW MATERIAL AND ROTARY KILN PLANT THEREFOR

[75] Inventor: Soren Bent Christiansen, Copenhagen Valby, Denmark

[73] Assignee: F. L. Smidth & Co., Cresskill, N.J.

[22] Filed: May 7, 1975

[21] Appl. No.: 575,407

[30] Foreign Application Priority Data

May 10, 1974 United Kingdom ..... 20839/74

[52] U.S. Cl. ..... 432/14; 432/58; 432/106; 106/100

[51] Int. Cl.[2] ..... F27B 15/00

[58] Field of Search ..... 432/14–16, 432/103, 58, 105–107; 34/10, 57 A, 57 R; 106/100

[56] References Cited

UNITED STATES PATENTS

| | | | |
|---|---|---|---|
| 3,162,431 | 12/1964 | Muller et al. | 432/16 |
| 3,364,589 | 1/1968 | Muller | 432/58 |
| 3,452,968 | 7/1969 | Shimizu et al. | 34/10 |
| 3,491,991 | 1/1970 | Abelitis | 432/16 |
| 3,752,455 | 8/1973 | Zacpal et al. | 432/58 |
| 3,843,314 | 10/1974 | Ishikawa | 432/16 |
| 3,869,248 | 3/1975 | Hirai et al. | 432/106 |
| 3,881,862 | 5/1975 | Nishida et al. | 432/106 |
| 3,904,353 | 9/1975 | Bosshand et al. | 432/14 |

FOREIGN PATENTS OR APPLICATIONS

| | | | |
|---|---|---|---|
| 1,184,744 | 1/1965 | Germany | 432/14 |

*Primary Examiner*—John J. Camby
*Assistant Examiner*—Henry C. Yuen
*Attorney, Agent, or Firm*—Pennie & Edmonds

[57] ABSTRACT

A method is disclosed for heat treating a preheated pulverous raw material containing at least a portion of lime to produce a partial calcination prior to passing the raw material down through an inclined rotary kiln for further heat treatment. Partial calcining is accomplished by introducing into at least one end of a rotary kiln an amount of fuel sufficient for preheating, at least partially calcining, and substantially completely sintering the raw material, at least part of the fuel being introduced into the lower material outlet end portion of the kiln. An amount of oxygen containing gas sufficient for substantial combustion of the fuel introduced into the kiln is introduced into the lower end portion of the kiln, and preheated raw material is introduced into the mouth of the kiln in such a manner that the material is entrained in gases exiting from the kiln mouth. The gas and entrained material exiting from the kiln are directed into a calcination chamber communicating with the upper material inlet end portion of the kiln such that the material is at least partially calcined by the contact with the kiln exit gases. The material is thereafter separated from the kiln exit gases and reintroduced into the upper end of the kiln in a manner which permits it to pass through the kiln for further heat treatment while avoiding entrainment in the kiln exit gases. A rotary kiln plant for practicing the method is also disclosed which provides for at least partial calcining of the material initially introduced into the kiln and thereafter reintroducing the partially calcined material in such a manner as to promote passage down through the kiln for further heat treatment.

49 Claims, 4 Drawing Figures

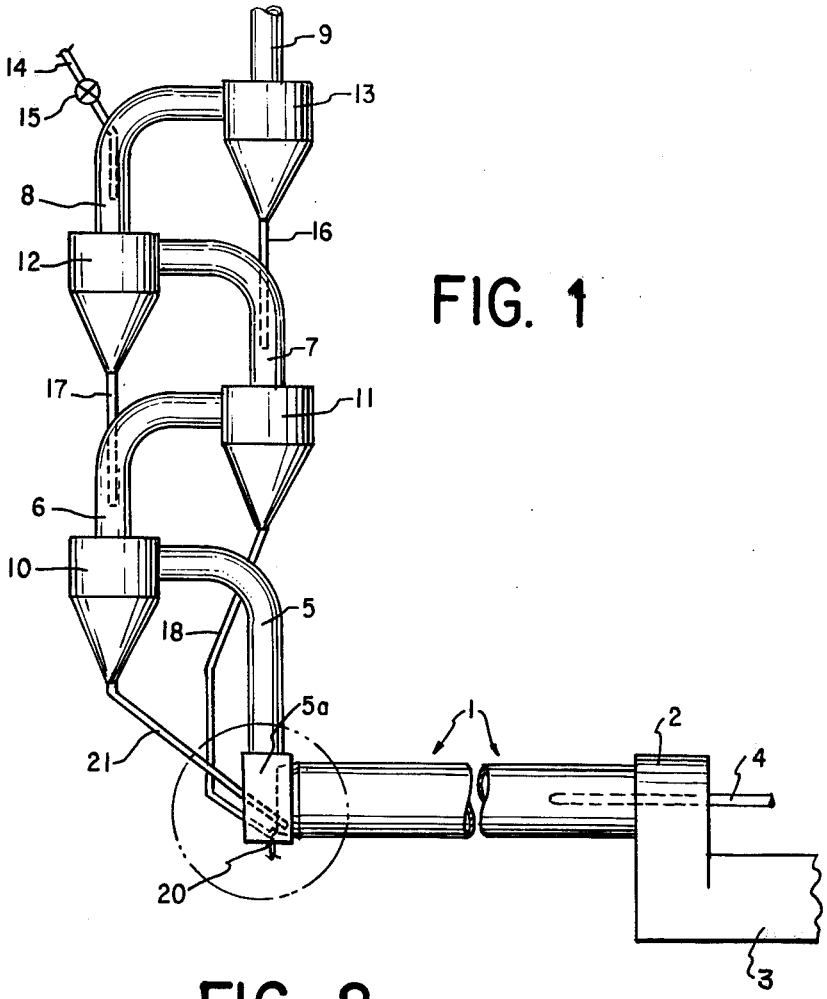
FIG. 1
FIG. 2
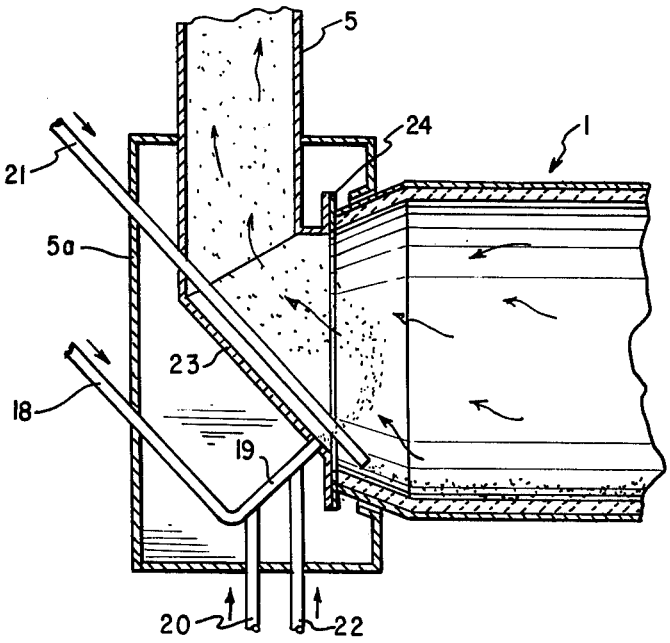

METHOD OF BURNING CALCINED AND UNCALCINED PULVEROUS RAW MATERIAL AND ROTARY KILN PLANT THEREFOR

BACKGROUND OF THE INVENTION

1. Field of the Invention

This invention relates to a method of burning pulverous raw materials containing lime, such as cement raw meal. The invention also relates to a rotary kiln plant for preheating, at least partially calcining, and burning of such materials.

2. Description of the Prior Art

Calcination of pulverous raw materials such as cement raw meal is to be understood as an expulsion of carbon dioxide ($CO_2$) from calcium carbonate by an endothermic process (i.e. a process in which heat is absorbed) according to the equation:

$$CaCO_3 \rightarrow CaO + CO_2$$

When the raw material is cement raw meal, the aforesaid finishing heat treatment following the calcination is a sintering by which cement clinker is produced. Sintering is an exothermic process characterized by, or formed with, evolution of heat. The sintering therefore only requires a modest supply of heat in order to raise the temperature of the raw material to the sintering temperature and to compensate for losses.

The heat necessary for carrying through the conversion of cement raw meal to cement clinker is usually obtained by buring fuel which together with combustion air, is introduced into a combustion chamber in which the fuel burns successively with the combustion air and forms smoke gas. As a result, the energy contained in the fuel is released for heating the smoke gas to a high temperature. The hot smoke gas is then brought into contact with the raw meal to be heat treated, i.e. preheated, calcined and burned. The heat treatment usually takes place as a continuous process in a rotary kiln with slightly inclining axis. Thus, the lower lying end of the rotary kiln is — as is usual for rotary kilns — designed as a combustion chamber.

However, in the manufacture of cement clinker from cement raw meal, by subjecting the raw meal in sequence to preheating, calcination and sintering, the current trend is toward performing the preheating in a separate multi-stage preheater, at least part of the calcination in a calcinator, and the sintering in a rotary kiln. The calcination may be initiated in the lower stages of the preheater and it may not be finished until the material being treated has been fed into the rotary kiln prior to the subsequent sintering. The lowermost stage of the preheater may form the calcinator or act as a calcinator in which a substantial part of the calcination takes place.

U.S. Pat. No. 3,203,681 to Rosa et al. relates to a process wherein heat for carrying through the calcination of preheated cement raw meal derives from hot gases having a temperature higher than the calcination temperature. The gases are produced in a separate chamber and are passed upwardly in a riser column in which the raw material is suspended and entrained by the gases thus produced.

In a related development, commonly assigned U.S. Pat. application Ser. No. 423,436, filed Dec. 10, 1973, now U.S. Pat. No. 3,955,995, dated May 11, 1976, is directed to calcination of pulverous material by mixing preheated raw material intimately with a fuel, capable of producing a combustible gas upon contacting the raw material, providing a gas capable of supporting combustion of the combustible gas thus produced to at least partially calcine the raw material, and separating the treated raw material from the stream of gases. A divisional of Ser. No. 423,436, now U.S. Pat. 3,955,995 is presently pending under Ser. No. 653,025, filed Jan. 28, 1976. Also, commonly assigned U.S. Pat. application Ser. No. 450,291, filed Mar. 12, 1974 relates to a method of heat treating a preheated pulverous raw material wherein the material is accumulated in a lower portion of a calcination chamber and an oxygen-containing gas is introduced into a flame overlying the accumulation.

As can be seen from these examples, in plants in which a major part of the calcination of the material being treated takes place outside the rotary kiln, the fuel and combustion air providing the heat for calcination may be provided in various ways. By way of another example, in copending commonly assigned application Ser. No. 559,705, filed Mar. 19, 1975, the riser pipe of the last preheater stage is designed to act as a calcinator and the hot partly calcined raw material entering the upper material inlet end of the inclined rotary kiln from the last preheater stage is mixed with solid or liquid fuel which, upon meeting the hot raw material, gives off combustible gas. This combustible gas, together with the kiln exit gas, passes to the calcinator in which preheated raw material from the penultimate preheater stage is suspended in the gas mix. Oxygen-containing gas is supplied to the calcinator so that the combustible gas is ignited and the preheated raw material is calcined to the desired extent. As disclosed in that earlier application, the oxygen-containing gas may be supplied to the calcinator through the kiln or as a separate supply by-passing the kiln.

Although it is simpler if the oxygen-containing gas is supplied through the kiln, in such an arrangement more oxygen-containing gas must be supplied to the lower end of the kiln than is necessary for nourishing in the kiln a flame which burns in the kiln for carrying out the heat treatment in the kiln. However, in order that the kiln gases shall have the necessary reaction temperature for the heat treatment in the kiln, extra fuel must be burnt in the kiln to raise the extra volume of oxygen-containing gas to the reaction temperature. However, the kiln reaction requires no greater heat because of the presence of the extra mass of oxygen-containing gas and consequently, the kiln gases leaving the kiln at the upper end of the kiln are at a higher temperature than they would otherwise be and indeed at such a high temperature that they may damage such parts as the upper mouth of the kiln, the adjacent rotary seal and the lower end of the riser pipe which directs the exit gases away from the kiln and serves as a calcinator.

The high temperature of the gases has another no less serious detrimental effect if — as is often the case — too great a quantity of compounds having a content of alkali, chlorine and sulphur is present in the cement raw materials. These compounds may, for the sake of convenience, be referred to as alkalis and they are present in the high temperature exit gases in a vaporised state. When these gases sweep the above-mentioned components adjacent to the upper kiln mouth, particularly the lower end of the said riser pipe, the gaseous alkalis will condense on these parts as troublesome solid coatings with embedded raw material.

The same two temperature problems exist if the heat for calcination is provided by burning extra fuel in the lower end of the kiln so that the kiln exit gases have a temperature high enough to perform an adequate calcination after they have left the kiln. I have invented an improved method and rotary kiln plant for preheating, at least partially calcining, and sintering such cement raw meal by supplying the oxygen containing gas through the kiln while avoiding the inherent disadvantages described.

SUMMARY OF THE INVENTION

A method of heat treating a preheated, pulverous raw material consisting entirely of, or at least containing a portion of lime to produce at least a partial calcination thereof prior to passing the raw material down through an inclined rotary kiln for further heat treatment, comprising introducing into at least one of the upper material inlet end portion and lower material outlet end portion of the kiln, an amount of fuel sufficient for preheating, at least partially calcining, and substantially completely burning the raw material, at least part of said fuel being introduced into the lower inlet end portion of the kiln, introducing into the lower end portion of the kiln an amount of oxygen containing gas sufficient for substantial combustion of the fuel introduced into the kiln and introducing preheated raw material into the upper end portion of the kiln in such a manner that the material is entrained in gases exiting from the upper material inlet end portion of the kiln. The method further comprises directing the gases and entrained material exiting from the upper end portion of the kiln into a calcination chamber communicating with the upper material inlet end portion of the kiln and permitting the material to be at least partially calcined by the contact with said kiln exit gases, separating the at least partially calcined material from the kiln exit gases and reintroducing the raw material so separated into the upper material inlet end portion of the kiln in such a manner that said material is permitted to pass through the kiln for further heat treatment while substantially avoiding entrainment by the kiln exit gases.

Preferably the raw material is preheated in a multistage cyclone suspension preheater which is coupled to the upper material inlet end portion of the rotary kiln and the hot raw material is brought into contact with the kiln exit gases in the upper end of the kiln in such manner that the material is carried out of the kiln suspended in the kiln exit gases and while in suspension, is at least partly calcined by the heat contained in the gases which is added to the upper and/or lower end portion of the kiln and the combustion of which, is substantially nourished by the air or other oxygen-containing gas introduced through the lower end portion of the kiln.

Since the hot kiln exit gases are brought into contact with the preheated raw material in the upper material inlet end portion of the kiln thereby initiating its heat consuming calcination, the temperature of the kiln exit gases is thus reduced sufficiently to avoid damage to the constructional parts adjacent to the upper kiln mouth and to avoid formation of coatings on these parts. No condensation on the parts will occur because the gaseous alkalis will solidify into very small particles in the gases as soon as the temperature of the gases is reduced, rather than solidifying on the relatively cold parts referred to.

An important advantage is that it is possible to obtain an increased output from a rotary kiln of given size or an appreciable reduction in the size of the rotary kiln for a given output. An increased output for a given kiln represents an increased throughput of raw material and in increased consumption of fuel and combustion air in the kiln proper. The advantage results from the fact that the contact between the preheated raw material and the hot kiln gases immediately before they leave the kiln caused an instantaneous and appreciable fall in the temperature of the hot kiln gases so that it is possible to operate the kiln throughout its length with gases at a much higher temperature than would otherwise be the case.

Preferably, the raw material is preheated in a multistage suspension preheater, the preheated raw material from the penultimate stage of the preheater being brought into contact with the kiln exit gases in the upper end of the kiln and being subsequently separated from the gases in the last stage of the preheater. The multi-stage suspension preheater may be cyclone string preheater so that at least a part of the calcination takes place in a calcinator formed by the riser pipe of the lowermost cyclone forming the last preheater stage.

The whole of the heat required for the calcination and preheating of the raw material may be transferred to the material by contact with the kiln exit gases provided by burning sufficient fuel in the lower end of the rotary kiln, calcination being performed at least partly and the preheating being performed in full, outside the kiln.

Alternatively, extra fuel may be supplied to the upper end of the kiln for combustion with additional oxygen-containing gas supplied with the kiln exit gases through the kiln. This has the advantage that the fuel to provide the heat for calcination is provided by burning the additional fuel supplied to the upper end of the kiln. As far as the individual particles of raw material are concerned, the heat is therefore generated at the place of consumption, that is at the location where the raw material particles are suspended inter alia in the burning combustible gas. The calcination therefore takes place approximately isothermally and at a relatively low temperature.

Although it is not essential, it is nevertheless preferred to supply fuel to the upper end of the kiln and mix the fuel with the preheated raw material before the material is brought into contact with the kiln exit gases in the upper end of the kiln. The fuel may be a gas or it may be a solid material such as powdered coal, or a liquid material such as oil, which gives off combustible gas upon intimate mixing with the hot preheated raw material.

The preheated raw material may be fluidized immediately before being brought into contact with the kiln exit gases. Thus as will be seen from the description which follows, the material may be supplied, for example, through a V-shaped pipe to the downstream branch of which fluidizing gas is supplied, of the type disclosed for example in U.S. Pat. No. 3,955,995. The fluidizing gas may be formed by air or, when additional fuel is supplied, by the fuel and/or air.

When air is supplied at the upstream end of the kiln for fluidization, it may be provided by waste cooling air which has been heated in a cooler in which the treated material leaving the kiln is subsequently cooled.

The heat necessary for the calcination and for the preheating of the material in the preheater will be provided by the combustion of any additional fuel provided at the upper end of the kiln, together with a balance of heat provided in the kiln exit gases from the fuel burnt in the lower end of the kiln after the heat treatment reaction in the kiln. The total heat for the preheating and calcination of the raw material and for the finishing heat treatment of the material in the kiln will thus be provided by the combustion of any additional fuel provided at the upper end of the kiln together with the combustion of the fuel at the lower material outlet end portion of the kiln, the two quantities of fuel being adjusted accordingly. Preferably, however, no more than 75 percent of the total heat energy requirement is provided by combustion of additional fuel supplied at the upper material inlet end portion of the kiln.

The invention also relates to a plant for heat treating substantially uncalcined preheated pulverous raw material consisting entirely of, or at least containing a portion of lime comprising an inclined rotary kiln for heat treating the raw material, the kiln having an upper material inlet end portion and a lower material outlet end portion, preheater means connected to the upper material inlet end portion of the kiln for preheating raw material prior to being introduced into the kiln, first means for feeding raw material from the preheating means to the upper material inlet end portion of the kiln in such a manner that the material is entrained by the kiln exit gases and carried out of the upper end portion thereof while being at least partially calcined by the contact with said gases. The plant further comprises means communicating with the upper material inlet end portion of the kiln for separating the at least partially calcined raw material from the kiln exit gases, and a second means for feeding the preheated, at least partially calcined raw material from the separating means into the upper inlet end portion of the kiln in such a manner that said material passes down through the kiln for further heat treatment without becoming entrained in the kiln exit gases.

Preferably, the preheater and separator are formed by a cyclone string preheater, of which a riser pipe for the last cyclone stage forms a calcinator and is sealed to the upper end of the kiln. The raw material feeding means feeds raw material from the penultimate cyclone stage into the upper end of the kiln so that the material is entrained by the kiln gases and thereby carried up the rise pipe of the lowermost cyclone stage which acts as a separator. The second raw material feeding means feeds material from the lowermost cyclone stage into the kiln so as to travel down the kiln. Most simply, the second raw material feeding means discharges into the upper material inlet end portion of the kiln downstream of the position of discharge of the first raw material feeding means.

There may, of course, be two or more multi-stage preheaters in parallel, the material outlets from the penultimate and last stages of the preheaters leading separately to the upper end of the kiln or being combined with corresponding outlets from the other preheaters before reaching the kiln.

As it will become clear from the description that follows, the instant development includes advantages over currently utilized techniques which include — but are not limited to — the following. For example, whereas according to earlier techniques fuel was added to both ends of the rotary kiln, in the present development, fuel addition at the upper end portion of the kiln may be dispensed with. Also, the instant development, raw meal which is at least partly calcined, and raw meal which is only preheated are fed separately to the upper kiln end with or without an addition of fuel. The at least partly calcined raw meal proceeds down through the kiln to be further heat treated and finally sintered, whereas the preheated raw meal is seized by and suspended in the combined gas flow passing out of the kiln. However, prior to actually exiting the mouth of the kiln, a calcination of the suspended raw meal is at least initiated, and if not completed, the calcination proceeds while the raw meal particles pass up through the riser pipe. The fuel required for producing the heat necessary for carrying through the calcination is added at the lower, or at the upper kiln end or at both ends, and the combustion air (preferably heated by the clinker cooler) for nourishing the combustion of the fuel is added at the lower kiln end, notwithstanding the kiln end portion in which the fuel is added. Thus in any event, at least some fuel is added to the lower kiln end, for example, that required for carrying through the sintering process in the kiln.

BRIEF DESCRIPTION OF THE DRAWINGS

Preferred embodiments of the invention are described hereinbelow with reference to the drawings wherein:

FIG. 1 is a diagrammatic representation of a complete plant for burning cement;

FIG. 2 is an enlarged diagrammatic representation of a vertical section through the parts encircled in FIG. 1.

DETAILED DESCRIPTION OF THE PREFERRED EMBODIMENTS

Figure 3:
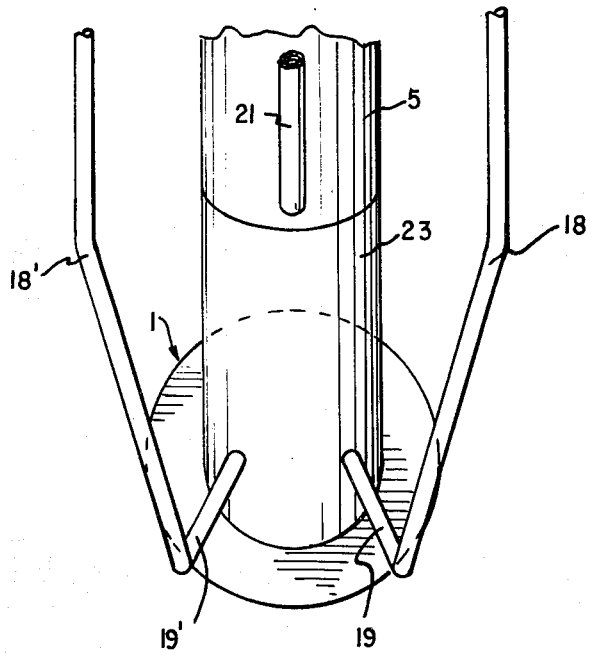
FIG. 3 is a diagrammatic representation of a view as seen from the left in FIG. 2.

The plant shown in FIG. 1 has an inclined rotary kiln 1 which discharges clinker through a stationary hood 2 into a clinker cooler 3. A burner pipe 4 extends into the lower end of the kiln.

The other end of the kiln is connected to a multi-stage cyclone string preheater. The preheater has a first riser pipe 5 sealed to the upper end of the kiln 1 by means of a hood 5*a*, and conventional riser pipes 6, 7 and 8; and a waste gas outlet 9 which discharges the waste gas through a dust precipitator (not shown) to the atmosphere. In conventional fashion the riser pipes interconnect cyclones 10, 11, 12, and 13. Raw material is supplied to the preheater through a pipe 14 under the control of a valve 15. Also in the conventional manner the cyclones 13 and 12 discharge the solid material separated in those cyclones to the preceeding riser pipes through outlets 16 and 17.

The material outlet from the penultimate cyclone 11 however leads through a pipe 18 terminating in a V-shape, the downstream branch 19 of which leads into the upper mouth of the kiln 1 at a location and direction that the material is entrained in the kiln exit gases while in the kiln proper. The outlet from the last cyclone 10 leads through a pipe 21 into the upper inlet end portion of the kiln 1 and discharges downstream of the discharge from the pipe 19.

The material passing into the material inlet end portion (upper mouth) of the kiln through the branch 19 is fluidized by air supplied through a pipe 20. The air may be provided — for example — by waste cooling air from the cooler 3 (not shown). A small amount of air is sufficient to cause the material to be blown into the kiln in a fluidized state. However, the amount is insufficient to contribute to any substantial extent to the combustion of any fuel added to the upper kiln mouth. The oxygen required for that purpose is contained in the kiln gases.

FIG. 2 shows the construction at the upper mouth of the kiln in further detail. This Fig. shows the optional addition of fuel through a pipe 22 to the fluidized material in the branch 19. It also shows that the hood 5*a* may have a sloping floor 23, and the rotary seal 24 between the upper end of the kiln and the stationary parts of the plant.

The material discharged from the pipe 19 into the upper mouth of the kiln is entrained by the kiln gases and carried up into the riser pipe 5 which forms a calcinator.

FIG. 3 shows two pipes, 18, 18′, leading into branches 19, 19′, from two separate parallel cyclone string preheaters. The two pipes 18, 18′, may of course join into one pipe 18, before reaching the kiln as suggested by the single 21 in FIG. 3 which can be considered as a continuation of two pipes 21, 21′ from the last cyclone in the two parallel cyclone string preheaters.

If no fuel is added through the pipe 22 in FIG. 2, the heat required for carrying through the final heat treatment, i.e. the sintering (which always takes place in the kiln), the calcination and the preheating of the material, is provided by burning fuel from burner pipe 4, in the presence of combustion air at the lower end of the kiln. As a result, very hot combustion gases will flow up through the kiln and out of its upper mouth.

The calcination is a heat-consuming process. Therefore, before the kiln gases have left the kiln mouth, they will have given off a substantial part of their heat to effect the calcination, i.e. their temperature will fall considerably and the fall will continue while the gases pass through the riser pipe 5 working, to some extent, as a calcinator. Without the addition of preheated raw material through the pipe 19 (i.e. if the raw material from the penultimate preheater 11 were fed into the top of the riser pipe 5 in more conventional fashion) the hot gases would damage the mouth of the kiln 1, seal 24, and the lower part of the riser pipe 5 (hood 5*a*) and would probably cause these constructional parts to be coated with crustations.

A feature of the present invention resides in the positioning and the angle of discharge of the preheated raw material which particularly facilitates at least a partial calcination of the raw material at the upper end portion of the kiln and in the riser pipe 5 by being entrained by the kiln exit gases. In the construction shown in FIGS. 1, 2 and 3, this is achieved by blowing the preheated raw material into the upper kiln end through pipe 19. As soon as the raw material particles meet the hot gases, their calcination will be initiated and before the gases have passed out through the kiln mouth a substantial calcination will have taken place. However, calcination proceeds while the material suspended in the gas passes through the riser pipe 5 and may not even be completed until the material has passed through the loop 5, 10, 21 and passed down through the kiln 1. Thus by the addition of the raw material in this manner at the particular location as described, the desired result is achieved.

If an amount of fuel, ordinarily up to about 75% of the total amount of fuel required for the three processes — preheating, calcining and sintering — added through the pipe 19, the amount of fuel to be introduced and burned at the burner pipe 4, in the presence of combustion air at the lower end will be correspondingly less. However, a surplus of combustion air will have to be added so that there is enough oxygen in the kiln gases to nourish the combustion of the fuel added at the upper mouth of the kiln. In other words, these gases are oxygen-containing and the less fuel is introduced at the lower kiln end, the more oxygen the gases will contain and the less hot these gases will be.

When fuel is added adjacent to the upper inlet end of the kiln, it will burn when it meets the more or less hot oxygen-containing kiln gases with the consequences that the gases (and the new combustion gas) will be subjected to a rise in temperature which will be the greater the more fuel is added adjacent to the kiln mouth. But for the simultaneous addition of preheated raw material adjacent to the upper kiln mouth, these hot gases would have the detrimental effects previously pointed out. The added raw material disposes of the heat contained in the gases to effect the calcination and so the temperature of the gases is reduced as desired:

The pipe 21 through which fully calcined or almost fully calcined material is carried to the kiln opens inside the kiln upstream in the gas flow in relation to the mouth of pipe 19 and near the bottom part of the kiln, i.e. it dips or almost dips into the charge in the kiln. The position of the pipe 21 prevents the material streaming therefrom from being seized by the kiln exit gases due to the downwardly inclined position of pipe 21 with respect to the kiln axis and the location of the material discharge outlet being upstream — with respect to the kiln exit gases — of the material discharge outlet of the pipe 19. This is in contrast to the location and orientation of the preheated material feed pipe 19 which is oriented at an upwardly inclined angle with respect to the kiln axis and is located particularly to facilitate entrainment of the raw material by the kiln exit gases as shown.

Figure 4:
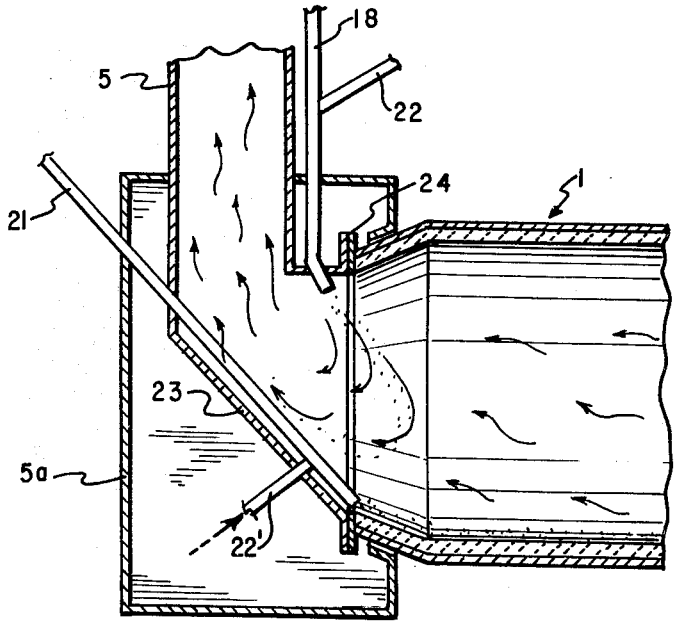
FIG. 4 is a modified detail of the plant according to FIG. 2 in which the preheated raw material is discharged into the upper kiln mouth from the top of the kiln.

FIG. 4 shows a modification in which the pipe 18 discharges from the above into the upper inlet end portion of the kiln. Like FIG. 2, FIG. 4 shows the optional additional fuel through a pipe 22. However, the fuel addition may alternatively be made from below as indicated by the dotted arrow 22′. If that alternative mode of operation is adopted the raw meal and the fuel will not be mixed beforehand, but a very intimate mixing is obtained all the same because the fuel is blown into the vigorous eddies formed by the suspended raw meal in the kiln mouth.

I claim:

1. A method of heat treating pulverous raw material consisting entirely of or at least containing a portion of the time to produce at least a partial calcination thereof prior to passing the material down through an inclined rotary kiln for further heat treatment, the kiln having hot gases generated therein and communicating at its material inlet end portion with a multistage raw material preheating means and a calcination chamber through which the hot kiln gases are directed comprising:

a. introducing into at least one of the upper material inlet end portion and lower material outlet end portion of the kiln, an amount of fuel sufficient for preheating, at least partially calcining, and substantially completely burning the material, at least part of said fuel being introduced into the lower end portion of the kiln;

b. introducing into the lower end portion of the kiln an amount of oxygen-containing gas sufficient for substantial combustion of the fuel introduced into said kiln;

c. introducing pulverous raw material into the multistage preheating means;

d. preheating the raw material in said multistage preheating unit by contact with hot gases exiting from the kiln;

e. introducing the preheated material from the penultimate stage of the preheating means into the upper material inlet end portion of the kiln proper at a location and in a manner to cause substantially all of the material to be entrained by the hot kiln exit gases exiting from the upper inlet end portion of the kiln;

f. directing said hot kiln exit gases and entrained material from the upper material inlet end portion of the kiln into the calcination chamber communicating therewith and permitting said material to be at least partially calcined by the contact with said hot kiln exit gases;

g. directing the hot kiln exit gases and the at least partially calcined material entrained therein to the last stage of the preheating means;

h. separating the at least partially calcined material from said hot kiln exit gases in said last stage; and i. re-introducing said separated material into the upper material inlet end portion of the kiln proper along a separate path and at a location downstream with respect to the material flow in the kiln, of the location of initial introduction of the preheated material into the kiln, and causing the material to pass through the kiln for further heat treatment while substantially avoiding entrainment by the hot kiln exit gases.

2. The method according to claim 1 further comprising:

a. preheating the raw material in a multi-stage cyclone suspension preheater;

b. bringing the preheated raw material from the penultimate stage of the preheater into contact with the kiln exit gases in the upper end of the kiln; and c. separating the at least partially calcined raw material from the kiln exit gases in the last cyclone stage of said preheater.

3. The method according to claim 1 further comprising:

a. supplying fuel to the upper material inlet end portion of the kiln; and b. mixing the fuel with the hot raw material prior to bringing said material into contact with the kiln exit gases.

4. The method according to claim 2 further comprising:

a. supplying fuel to the upper material inlet end portion of the kiln; and b. mixing the fuel with the hot raw material prior to bringing said material into contact with the kiln exit gases.

5. The method according to claim 3 further comprising mixing the hot raw material with at least one of a gas, solid and liquid fuel capable of producing a combustible gas upon contacting said hot raw material.

6. The method according to claim 1 further comprising fluidizing the hot raw material immediately prior to contacting the kiln exit gases.

7. The method according to claim 2 further comprising fluidizing the hot raw material immediately prior to contacting the kiln exit gases.

8. The method according to claim 3 further comprising fluidizing the hot raw material immediately prior to contacting the kiln exit gases.

9. The method according to claim 4 further comprising fluidizing the hot raw material immediately prior to contacting the kiln exit gases.

10. The method according to claim 5 further comprising fluidizing the hot raw material immediately prior to contacting the kiln exit gases.

11. The method according to claim 6 further comprising introducing into the upper material inlet end portion of the kiln, a fluidizing gas in the form of at least one of air and a mixture of air and gaseous fuel.

12. The method according to claim 1 further comprising providing fuel at the upper and lower end portions of the kiln sufficient to support the preheating, calcining and finishing heat treatment of the raw material in the kiln.

13. The method according to claim 2 further comprising providing fuel at the upper and lower end portions of the kiln sufficient to support the preheating, calcining and finishing heat treatment of the raw material in the kiln.

14. The method according to claim 3 further comprising providing fuel at the upper and lower end portions of the kiln sufficient to support the preheating, calcining and finishing heat treatment of the raw material in the kiln.

15. The method according to claim 4 further comprising providing fuel at the upper and lower end portions of the kiln sufficient to support the preheating, calcining and finishing heat treatment of the raw material in the kiln.

16. The method according to claim 5 further comprising providing fuel at the upper and lower end portions of the kiln sufficient to support the preheating, calcining and finishing heat treatment of the raw material in the kiln.

17. The method according to claim 6 further comprising providing fuel at the upper and lower end portions of the kiln sufficient to support the preheating, calcining and finishing heat treatment of the raw material in the kiln.

18. The method according to claim 7 further comprising providing fuel at the upper and lower end portions of the kiln sufficient to support the preheating, calcining and finishing heat treatment of the raw material in the kiln.

19. The method according to claim 11 further comprising providing fuel at the upper and lower end portions of the kiln sufficient to support the preheating, calcining and finishing heat treatment of the raw material in the kiln.

20. The method according to claim 12 further comprising supplying fuel at the upper material inlet end portion of the kiln sufficient to supply up to approximately 75 percent of the total heat energy required for preheating, at least partially calcining, and substantially completely sintering said raw material.

21. A method of preheating and at least partially calcining pulverous raw material preferably in the form of cement raw meal, prior to passing the material down through an inclined rotary kiln for sintering to form a final product such as cement clinker, the kiln having hot gases generated therein and communicating at its upper material inlet end portion with a multistage cyclone suspension preheater for preheating the raw material, and a calcination chamber in the form of a smoke gas riser pipe through which the hot kiln gases may be directed for at least partially calcining the preheated material comprising:

a. introducing into at least one of the upper material inlet end portion and the lower material outlet end portion of the kiln, an amount of fuel sufficient for preheating, at least partially calcining, and sintering the raw material, at least part of said fuel being introduced into the lower end portion of the kiln;
b. introducing into the lower end portion of the kiln an amount of oxygen-containing gas sufficient for substantial combustion of the fuel introduced into said kiln;
c. introducing the raw cement material into the multistage cyclone suspension preheater;
d. preheating the raw cement material in said multistage cyclone preheater by contact with hot gases exiting from the kiln;
e. introducing the preheated cement material from the penultimate stage of the multistage preheater into the upper material inlet end portion of the kiln proper at a location and in a direction to cause the material to be entrained in hot gases exiting from the kiln and at least partially calcining said material in said exit portion within the kiln proper, the calcination process requiring sufficient heat as to maintain the temperature developed at the exit portion of the kiln proper below predetermined levels;
f. directing said hot kiln exit gases and entrained material exiting from the upper material inlet end portion of the kiln into said riser pipe communicating with the upper material inlet end portion of the kiln and with the last cyclone stage of said preheater in a manner which facilitates further calcination of said preheated material during passage through said riser pipe by contact with said hot kiln exit gases;
g. separating the at least partially calcined cement material within said last cyclone stage; and
h. re-introducing said separated, at least partially calcined cement material from the said last cyclone stage of said preheater to the upper material inlet end portion of the kiln proper along a separate path and at a location upstream, with respect to the kiln exit gases, of the point of initial introduction of said preheated cement material and in a direction inclined generally downwardly with respect to the kiln such that the material passes down through the kiln for further heat treatment while avoiding entrainment in the hot kiln exit gases.

22. The method according to claim 21 further comprising introducing said preheated raw material from the penultimate cyclone stage of said preheater in a direction inclined generally upwardly with respect to the kiln axis and in a direction generally opposite the direction of flow of gases exiting from said kiln.

23. The method according to claim 21 further comprising introducing said preheated raw material from the penultimate cyclone stage of said preheater in a direction inclined generally downwardly with respect to the kiln axis and generally opposite to the flow of gases exiting from said kiln.

24. The method according to claim 22 further comprising introducing said preheated, at least partially calcined material from said last cyclone stage of said preheater into the material inlet end portion of the kiln in a direction inclined generally downwardly with respect to the kiln axis and in a direction generally opposite to the flow of gases exiting from the kiln.

25. The method according to claim 23 further comprising introducing said preheated, at least partially calcined material from said last cyclone stage of said preheater into the material inlet end portion of the kiln axis in a direction inclined generally downwardly with respect to the kiln and in a direction generally opposite to the flow of gases exiting from the kiln.

26. A plant for heat treating pulverous raw material consisting entirely of or at least containing a portion of lime which comprises an inclined rotary kiln for heat treating the material, said kiln having an upper material inlet end portion and a lower material outlet end portion, a calcination chamber communicating with the upper material inlet end portion of the kiln, raw material preheating means communicating with the calcination chamber and the upper material inlet end portion of the kiln for preheating the material prior to feeding it to the material inlet end portion of the kiln, means for feeding material from the preheating means to the upper material inlet end portion of the rotary kiln proper in such a manner that the material is entrained in the hot kiln exit gases and carried out of the upper material inlet end portion of the kiln and at least partially calcined by the contact with said hot kiln gases, separator means communicating with the upper material inlet end portion of the kiln and the calcination chamber for separating the at least partially calcined material from the hot kiln exit gases, means for feeding the preheated, at least partially calcined material from said separator means into the upper material inlet end portion of the kiln proper along a separate path and at a location downstream with respect to the flow of material in the kiln, of the location of initial introduction of the preheated material into the kiln, and in such a manner that said material passes down through the kiln for further heat treatment without becoming entrained in the kiln exit gases.

27. The plant according to claim 26, further comprising cooling means connected to the lower material outlet end portion of the kiln for cooling a final product of the kiln heat treatment.

28. The plant according to claim 27 further comprising at least one multi-stage cyclone suspension preheater for preheating the raw material prior to being introduced into the rotary kiln, a calcinating chamber sealed in communicating relation with the upper material inlet end portion of the kiln and formed by a riser pipe for the last cyclone stage of at least one preheater string, a first means for feeding the preheated raw material from the penultimate cyclone stage of at least one preheater into the upper material inlet end portion of the kiln in such a manner that the material is entrained by the kiln exit gases and carried into said calcinator and to the separator formed by the lowermost cyclone stage of said preheater, a second means for feeding the preheated, at least partially calcined material separated from the kiln exit gases from the lowermost cyclone stage into the material inlet end portion of the kiln in such a manner that the material substantially avoids entrainment in the kiln exit gases and passes down through the kiln for further heat treatment.

29. The plant according to claim 28 wherein said first means for feeding preheated raw material into the material inlet end portion of the kiln is positioned and oriented to feed raw material in a direction generally inclined upwardly with respect to the kiln axis and generally opposite the flow of kiln exit gases to permit entrainment of the raw material by said kiln exit gases and said second means for feeding preheated, at least partially calcined raw material is positioned downstream with respect to the flow of kiln exit gases, of the material discharge outlet for said first feeding means, and oriented to discharge material into the upper material inlet end portion of the kiln in a generally downwardly inclined direction to substantially avoid entrainment in the kiln exit gases.

30. The plant according to claim 28 wherein said first means for feeding preheated raw material into the material inlet end portion of the kiln is positioned and oriented to discharge raw material in a direction inclined generally downwardly with respect to the kiln axis and generally opposite the flow of kiln exit gases and said second feeding means is oriented to discharge material into the upper material inlet end portion of the kiln in a generally downwardly inclined direction and at a location which substantially avoids entrainment in said kiln exit gases.

31. The plant according to claim 26 further comprises means for supplying a fluidizing gas to the raw material immediately prior to bringing the material in contact with the kiln exit gases.

32. The plant according to claim 27 further comprising means for supplying a fluidizing gas to the raw material immediately prior to bringing the material in contact with the kiln exit gases.

33. The plant according to claim 28 further comprising means for supplying a fluidizing gas to the raw material immediately prior to bringing the material in contact with the kiln exit gases.

34. The plant according to claim 29 further comprising means for supplying a fluidized gas to the raw material immediately prior to bringing the material in contact with the kiln exit gases.

35. The plant according to claim 30 further comprising means for supplying a fluidized gas to the raw material immediately prior to bringing the material in contact with the kiln exit gases.

36. The plant according to claim 26 further comprising means for introducing fuel into the upper material inlet end portion of the kiln.

37. The plant according to claim 27 further comprising means for introducing fuel into the upper material inlet end portion of the kiln.

38. The plant according to claim 28 further comprising means for introducing fuel into the upper material inlet end portion of the kiln.

39. The plant according to claim 29 further comprising means for introducing fuel into the upper material inlet end portion of the kiln.

40. The plant according to claim 36, wherein said means for introducing fuel to the upper material inlet end portion of the kiln is positioned and adapted to discharge the fuel into the raw material prior to bringing the raw material into contact with the kiln exit gases.

41. The plant according to claim 37 wherein said means for introducing fuel to the upper material inlet end portion of the kiln is positioned and adapted to discharge the fuel into the raw material prior to bringing the raw material into contact with the kiln exit gases.

42. The plant according to claim 38 wherein said means for introducing fuel to the upper material inlet end portion of the kiln is positioned and adapted to discharge the fuel into the raw material prior to bringing the raw material into contact with the kiln exit gases.

43. The plant according to claim 39 wherein said means for introducing fuel to the upper material inlet end portion of the kiln is positioned and adapted to discharge the fuel into the raw material prior to bringing the raw material into contact with the kiln exit gases.

44. A plant for preheating, at least partially calcining and sintering pulverous raw material preferably in the form of cement raw meal which comprises an inclined rotary kiln for sintering the raw material, the kiln having hot gases generated therein, an upper material inlet end portion through which the hot gases are exited and a lower material outlet end portion through which the final kiln product such as cement clinker exits the kiln, at least one multistage cyclone suspension string preheater communicating with the upper material inlet portion of the kiln for preheating the cement material, a riser pipe communicating the upper material inlet end portion of the kiln with the preheater in which preheated cement material is at least partially calcined prior to being sintered in the rotary kiln, means for cooling the final kiln product after exiting the material outlet end portion of the kiln, means for feeding the preheated cement material from the penultimate cyclone stage of said preheater into the upper material inlet end portion of the kiln proper at a location and in a direction to cause the cement material to be entrained in the hot gases exiting the kiln and to be directed through said riser pipe to the last cyclone stage of said preheater while being at least partially calcined, means for feeding the at least partially calcined material from the last cyclone stage of said preheater to the upper material inlet end portion of the rotary kiln proper along a separate path and at a location upstream with respect to the kiln exit gases, of the location of initial introduction of the preheated material into the kiln and in a direction inclined downwardly with respect to the kiln to facilitate passing of the at least partially calcined cement material down through the kiln for further heat treatment without becoming entrained in the kiln exit gases.

45. The plant according to claim 44 wherein the first means for feeding said preheated raw material into the material inlet end portion of the kiln is oriented to discharge raw material in a direction inclined generally upwardly with respect to the kiln axis and generally opposite the direction of flow of the kiln exit gases.

46. The plant according to claim 45 wherein said second means for feeding the preheated, at least partially calcined raw material into the material inlet end portion of the kiln is positioned to discharge the material upstream with respect to said kiln exit gases of the point at which the preheated raw material from said first feeding means is discharged into the kiln and in a direction inclined generally downwardly with respect to the kiln axis to substantially avoid entrainment of the at least partially calcined raw material in the kiln exit gases.

47. The plant according to claim 46 further comprising means for introducing additional fuel to said preheated raw material passing through said first feeding means prior to becoming entrained with the gases exiting from the kiln.

48. The plant according to claim 47 further comprising means for directing fluidizing gas to said preheated raw material passing through said first feeding means for mixing therewith and for fluidizing said raw material with said additional fuel prior to becoming entrained by the gases exiting from the kiln.

49. The plant according to claim 44 further comprising at least two strings of multi-stage cyclone preheaters communicating with the material inlet end portion of the rotary kiln, means for feeding preheated raw material from the penultimate stage of each string of cyclone preheaters to the material inlet end portion of the kiln upwardly into the mouth of the kiln such that the raw material is entrained by the kiln exit gases, a riser pipe for directing preheated raw material entrained by the gases exiting from the kiln to the last cyclone separator stage of each string of preheaters while being at least partially calcined therein by the contact with the kiln exit gases, means for feeding the at least partially calcined raw material from the last cyclone separator cyclone stage of each string of preheaters into the material inlet end portion of the kiln in a manner such that said at least partially calcined raw material passes down through the kiln for further heat treatment while substantially avoiding entrainment by the kiln exit gases.

* * * * *

UNITED STATES PATENT AND TRADEMARK OFFICE

CERTIFICATE OF CORRECTION

PATENT NO. : 4,002,420

DATED : January 11, 1977

INVENTOR(S) : Soren Bent Christiansen

It is certified that error appears in the above-identified patent and that said Letters Patent are hereby corrected as shown below:

Column 1, line 32, "buring" should read -- burning --

Column 4, line 21, "may be cyclone" should read -- may be a cyclone --

Column 5, line 47, "kiln gases" should read -- kiln exit gases --

Column 6, line 1, "Also the instant" should read -- Also, in the instant --

Column 7, line 25, "the single 21" should read -- the single pipe 21 --

Column 8, line 3, "sintering - added" should read -- sintering - is added --

Claim 44, Column 14, lines 24-25, "inlet portion" should read -- inlet end portion --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*